US006151940A

United States Patent [19]

Amborn et al.

[11] Patent Number: 6,151,940

[45] Date of Patent: Nov. 28, 2000

[54] HYDROFORMING PROCESS

[76] Inventors: Ing Peter Amborn, In den Gärten 2, D-53819 Neunkirchen, Germany; Simon Jonathan Giles Griffiths, c/o GKN Sankey Limited, Engineering Products Division, Hadley Castle Works, P.O. Box 83, Telford, Shropshire, TF1 4RE, United Kingdom

[21] Appl. No.: 09/325,517

[22] Filed: Jun. 3, 1999

[51] Int. Cl.[7] ..... B21D 26/02

[52] U.S. Cl. ..... 72/62; 72/61

[58] Field of Search ..... 72/61, 60, 62; 29/421.1

[56] References Cited

U.S. PATENT DOCUMENTS

| | | | |
|---|---|---|---|
| 5,802,899 | 9/1998 | Klass et al. | 72/62 |
| 5,918,494 | 7/1999 | Kojima et al. | 72/62 |
| 5,927,119 | 7/1999 | Hamano et al. | 72/58 |
| 5,953,945 | 9/1999 | Horton | 72/58 |
| 5,960,658 | 10/1999 | Hudson et al. | 72/61 |
| 6,014,879 | 1/2000 | Jackel et al. | 72/61 |
| 6,016,603 | 1/2000 | Marando et al. | 72/61 |

*Primary Examiner*—David Jones
*Attorney, Agent, or Firm*—Kilpatrick Stockton LLP

[57] ABSTRACT

A process for hydroforming an elongate tubular structural member in a mould die, the structural member having portions spaced along its length which have different circumferential dimensions, a first of said portions having a first cross-sectional shape defining a minimum outer circumferential dimension $C_1$ and a second of said portions having a second cross-sectional shape defining a maximum outer circumferential dimension $C_2$, the process including the steps of: (i) selecting a precursor tube of constant cross-sectional shape and constant outer cross-sectional dimension along its length and having an outer circumferential dimension $C_0$ which is greater than or equal to $C_1$ and being of a cross-sectional shape which can be located within said first cross-sectional shape, and selecting the wall thickness $S_0$ of the precursor tube so as to fall within the range $S_0 \leqq S_1$ and $S_0 \geqq S_2$ wherein $S_1$ is the average wall thickness of said first portion and S2 is the average wall thickness of said second portion, and (ii) placing the precursor tube in the mould die and hydroforming the precursor tube to produce said tubular structural member.

4 Claims, 3 Drawing Sheets

HYDROFORMING PROCESS

The present invention relates to a hydroforming process, in particular but not exclusively, for the formation of tubular structural elements as used for example in the manufacture of motor vehicles.

Hydroforming of tubular components is usually achieved by locating a tubular blank within a mould die containing a mould cavity of the desired shape and feeding hydraulic fluid under pressure into the interior of the tubular blank so as to cause the blank to expand and the material forming the walls of the blank to elongate and flow into contact with the mould cavity and thereby be formed into the desired shape.

In addition, it is known to compress opposite axial ends of the tubular blank to place the blank under axial compression simultaneously with the application of the pressurised fluid. This causes the material to flow axially and so enables larger cross sectional dimensions to be achieved.

It will be appreciated therefore that the hydroforming process relies upon the elongation and flow capabilities of the material from which the blank is formed. Accordingly, difficulties can be encountered when producing a structural tubular element having a complex or highly asymmetrical cross sectional shape due to insufficient material being available at certain circumferential locations in the tubular blank; this can lead to wrinkling in the finished tubular structural element and/or undesirably thin walls in certain areas.

Similar difficulties are additionally encountered when producing tubular structural elements which are not of constant cross sectional shape and size along its length but instead has axially spaced portions which have differently sized cross sectional shapes.

According to one aspect of the present invention there is provided a process for hydroforming an elongate tubular structural element in a mould die, the structural element having portions spaced along its length which have different circumferential dimensions, a first of said portions having a first cross-sectional shape defining a minimum outer circumferential dimension $C_1$ and a second of said portions having a second cross-sectional shape defining a maximum outer circumferential dimension $C_2$, the process including the steps of:

(i) selecting a precursor tube of constant cross-sectional shape and constant outer cross-sectional dimension along its length and having an outer circumferential dimension $C_0$ which is greater than or equal to $C_1$ and being of a cross-sectional shape which can be located within said first cross-sectional shape, and selecting the wall thickness $S_0$ of the precursor tube so as to fall within the range $S_0 \leqq S_1$ and $S_0 \geqq S_2$ wherein $S_1$ is the average wall thickness of said first portion and $S_2$ is the average wall thickness of said second portion, and (ii) placing the precursor tube in the mould die and hydroforming the precursor tube to produce said tubular structural element.

According to another aspect of the present invention there is provided a hydroformed elongate structural element having portions spaced along its length which have different circumferential dimensions, a first of said portions defining a minimum circumferential dimension $C_1$ and a second of said portions defining a maximum circumferential $C_2$, the average wall thickness $S_1$ of said first portion being greater than the average wall thickness $S_2$ of said second portion.

Reference is now made to the accompanying drawings in which.

Figure 1:
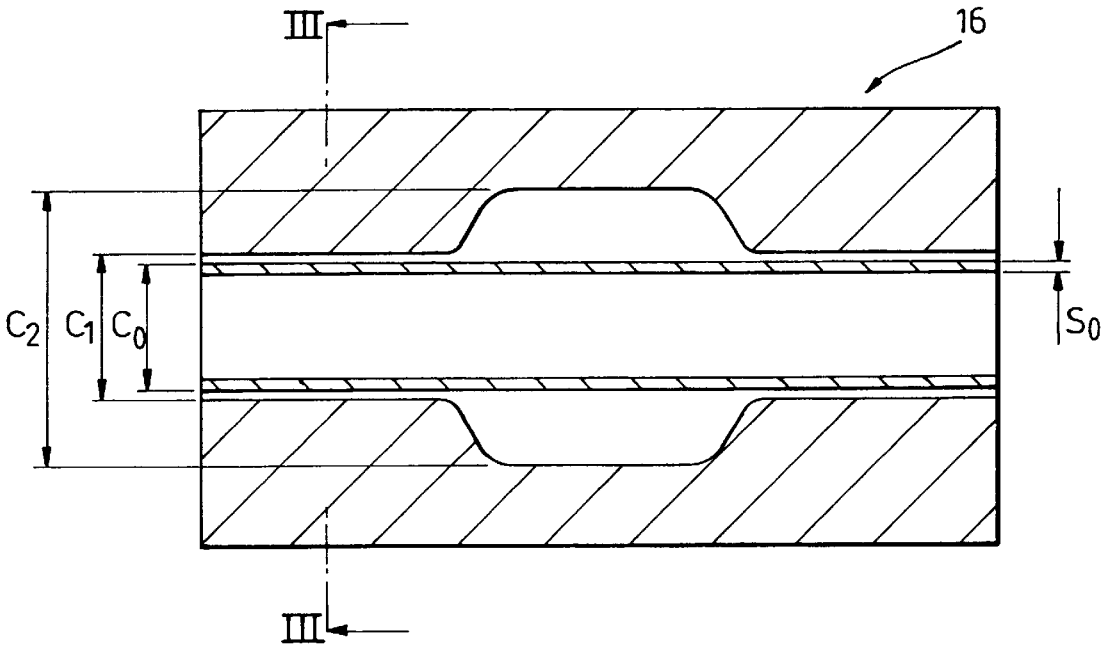
FIG. 1 is a schematic axial sectional view through a hydroforming die containing a precursor tube according to the present invention prior to hydroforming.
Figure 2:
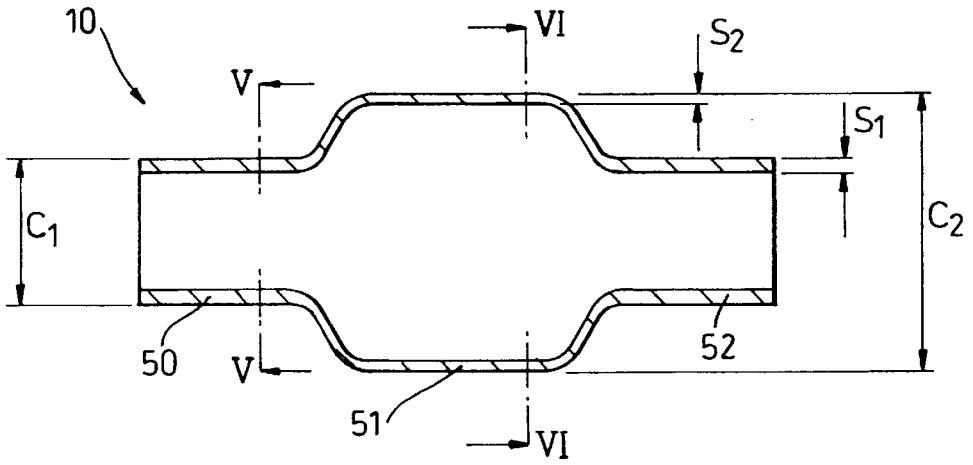
FIG. 2 is a schematic axial sectional view through an elongate structural element produced from the arrangement shown in FIG. 1.
Figure 3A:
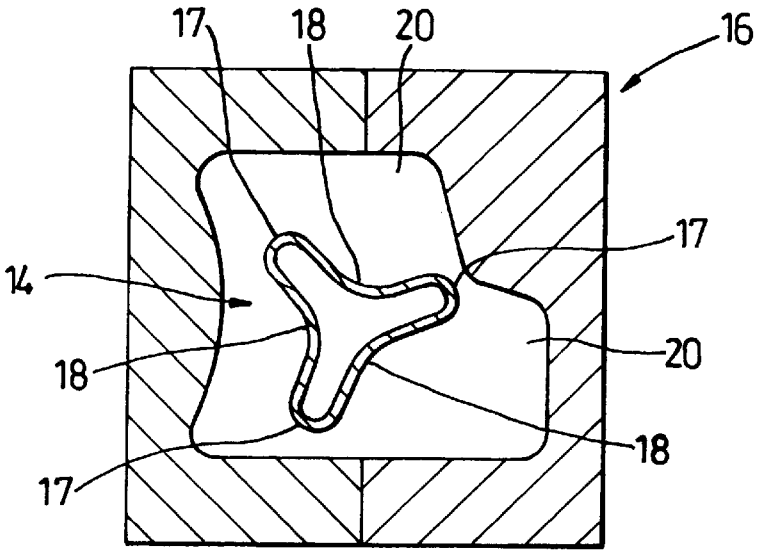
Figure 3B:
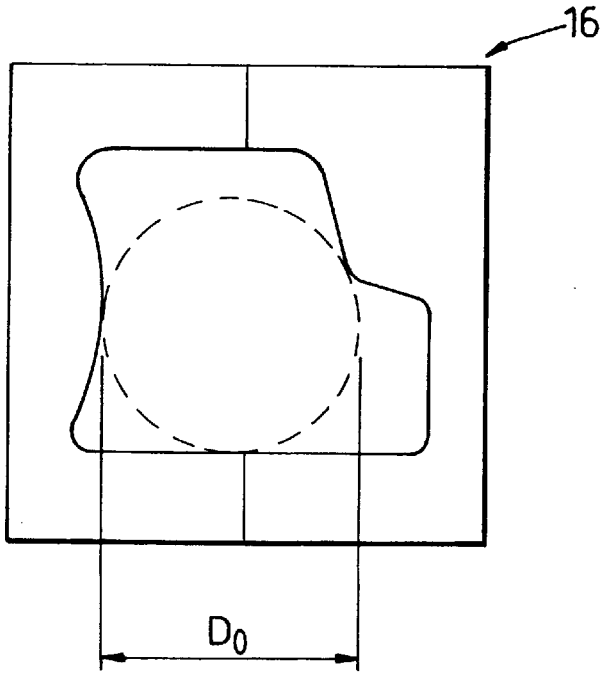
Figure 4:
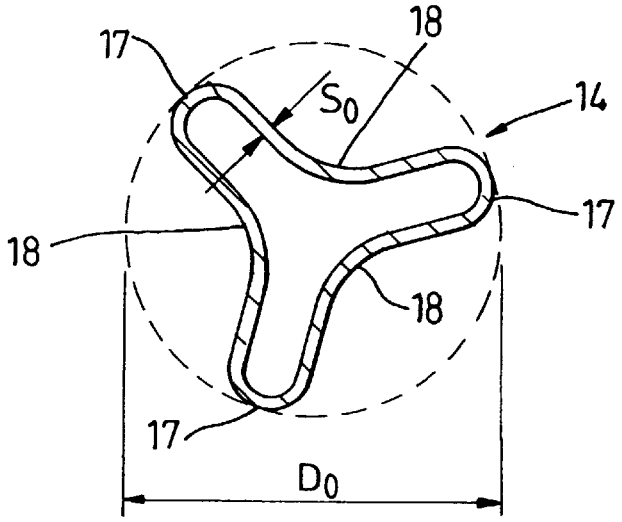
Figure 5:
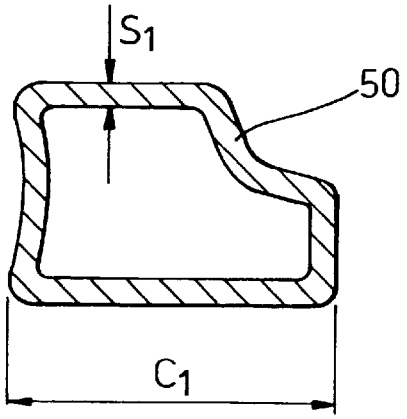
Figure 6:
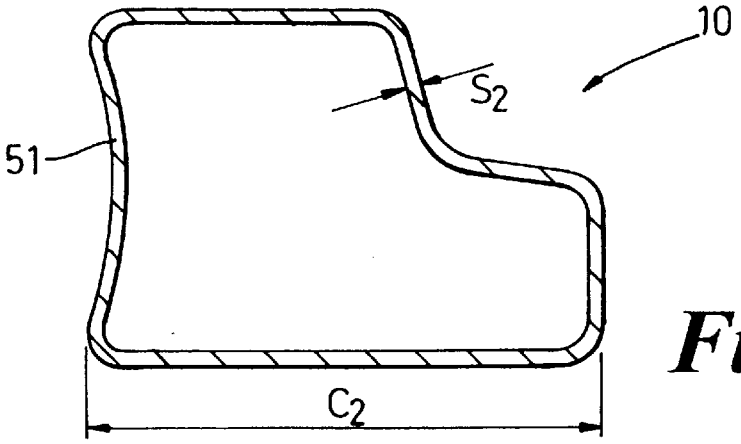

FIG. 3*a* is a cross sectional view taken along line III—III in FIG. 1;

FIG. 3*b* is a cross-sectional view similar to FIG. 3*b* diagrammatically showing the relationship between $D_0$ and the mould cavity;

FIG. 4 is an enlarged cross-sectional view of the precursor tube shown in FIG. 3;

FIG. 5 is a cross-sectional view taken along line V—V in FIG. 2;

FIG. 6 is a cross-sectional view taken along line VI—VI in FIG. 2.

Referring initially to FIG. 2 there is shown an elongate structural element 10 having first, second and third portions 50,51 and 52 respectively. In the example shown, the first and third portions 50,52 are of the same cross-sectional shape and dimension along their lengths. These portions define a minimum circumferential dimension $C_1$.

Portion 51 is of the same or different cross-sectional shape as portions 50,51 but is of greater circumferential dimension which in this example is a maximum circumferential dimension $C_2$.

The element 10 is formed by hydroforming techniques in a mould die 16 from a precursor tube 14 which is of constant cross-sectional shape and dimensions along its length. The precursor tube 14 is preferably shaped in cross-section so as to have a plurality of axially extending nodes 17 spaced by axially extending channels 18. This enables the circumferential dimension $C_0$ of the tube to be increased and yet remain within the boundaries of an imaginary minimum diameter $D_0$ (FIG. 4).

In the embodiment illustrated in FIG. 3*a* three axially extending nodes 17 are provided. The number and circumferential position of these nodes 17 is chosen bearing in mind the complexity of cross-sectional shape of the element to be formed so as to provided sufficient material for flowing into the radially outermost cavities during the hydroforming process. Usually therefore, the nodes will be arranged to face the radially outermost recesses or cavities 20.

If the cross sectional shape of the element 10 is not complex, for example it may be a simple geometric round or polygonal shape, nodes 17 may not be required and the precursor tube may have a simple geometric cross sectional shape. For example it may be circular in cross section, say of diameter $D_0$.

In order to enable the portion 51 of larger circumferential dimension $C_2$ to be produced, it is necessary that sufficient material is present at the axial locations of the precursor tube corresponding to the axial location of the second portion 51 and so provide the second portion with a desired average wall thickness $S_2$.

In accordance with the present invention this is achieved by selecting the circumferential dimension $C_0$ of the precursor tube is chosen to be sufficiently great and for the wall thickness $S_0$ of the precursor tube to fall with the range $S_0 \leqq S_1$ and $S_0 \geqq S_2$ wherein $S_1$ is the average wall thickness of portion 50 which defines the minimum circumferential dimension $C_1$ of the element and $S_2$ is the average wall thickness of portion 51 which defines the maximum circumferential dimension $C_2$ of the element 10. Accordingly the circumferential dimension $C_1$ will be greater or equal to the circumferential dimension $C_0$ of portion 50. The case where $C_0 = C_1$ will occur when the thickness $S_0$ is sufficient alone to enable the larger cross sectional portion 51 to be formed with the desired wall thickness $S_2$.

Accordingly when the precursor tube is expanded during the hydoforming process, the wall thickness in the portion 50 of minimum circumferential dimension $C_1$ will tend to increase compared with that of the precursor tube.

Conveniently, as seen in FIG. 3*b*, the diameter $D_0$ may be chosen to be the maximum diameter dimension which can be accommodated in that portion of the mould for forming the portion of the element 10 having the minimum circumferential dimension $C_1$. This ensures that the precursor tube 14 will easily fit within the mould prior to hydroforming.

It is to be appreciated that the term 'hydroforming' in accordance with the present invention is intended to cover the use of any pressurised fluid, eg. gas, liquid or solid particles and also covers the use of hot or cold fluid.

What is claimed is:

1. A process for hydroforming an elongate tubular structural member in a mould die, the structural member having portions spaced along its length which have different circumferential dimensions, a first of said portions having a first cross-sectional shape defining a minimum outer circumferential dimension $C_1$ and a second of said portions having a second cross-sectional shape defining a maximum outer circumferential dimension $C_2$, the process including the steps of:

(i) selecting a precursor tube of constant cross-sectional shape and constant outer cross-sectional dimension along its length and having an outer circumferential dimension $C_0$ which is greater than or equal to $C_1$ and being of a cross-sectional shape which can be located within said first cross-sectional shape and having at least two axially extending nodes, and selecting the wall thickness $S_0$ of the precursor tube so as to fall within the range $S_0 \leqq S_1$ and $S_0 \geqq S_2$ wherein $S_1$ is the average wall thickness of said first portion and $S_2$ is the average wall thickness of said second portion, and (ii) placing the precursor tube in the mould die and hydroforming the precursor tube to produce said tubular structural member.

2. A process according to claim 1 wherein the precursor tube has a cross sectional shape which may be contained within an imaginary minimum diameter $D_0$, $D_0$ being equal to or less than the maximum diametrical dimension $D_{max}$ which can be accommodated within said first portion.

3. A process according to claim 2 wherein the precursor tube is formed from a cylindrical tube by drawing or rolling operations.

4. A hydroformed elongate structural member having portions spaced along its length which have different circumferential dimensions, a first of said portions defining a minimum circumferential dimension $C_1$ and a second of said portions defining a maximum circumferential $C_2$, the average wall thickness $S_1$, of said first portion being greater than the average wall thickness $S_2$ of said second portion, and formed from a precursor member having at least two axially extending nodes.

* * * * *